US009755360B1

(12) United States Patent
Mayer

(10) Patent No.: US 9,755,360 B1
(45) Date of Patent: Sep. 5, 2017

(54) CONNECTOR GUIDE ASSEMBLY WITH A PROTRUDING MEMBER

(71) Applicant: Hewlett Packard Enterprise Development LP, Houston, TX (US)

(72) Inventor: David William Mayer, Fort Collins, CO (US)

(73) Assignee: Hewlett Packard Enterprise Development LP, Houston, TX (US)

( * ) Notice: Subject to any disclaimer, the term of this patent is extended or adjusted under 35 U.S.C. 154(b) by 0 days.

(21) Appl. No.: 15/179,538

(22) Filed: Jun. 10, 2016

(51) Int. Cl.
*H01R 13/64* (2006.01)
*H01R 13/629* (2006.01)

(52) U.S. Cl.
CPC ..... *H01R 13/629* (2013.01)

(58) Field of Classification Search
CPC H01R 13/631; H01R 13/629; H01R 12/7005; H01R 13/6315; H01R 13/518
See application file for complete search history.

(56) References Cited

U.S. PATENT DOCUMENTS 5,147,225 A * 9/1992 Kile ..... H01R 12/707 439/374
5,354,951 A * 10/1994 Lange, Sr. ..... H05K 9/0032 174/372
7,153,170 B1 * 12/2006 Fabian ..... H01R 13/518 439/284
2004/0033714 A1 * 2/2004 Maini ..... G01S 7/292 439/357

* cited by examiner

*Primary Examiner* — Xuong Chung Trans
(74) *Attorney, Agent, or Firm* — Brooks, Cameron & Huebsch, PLLC

(57) ABSTRACT

Examples herein disclose a connector guide assembly. The connector guide assembly includes a connector frame and multiple protruding members. The connector frame includes multiple side walls. The multiple protruding members are coupled to the side walls of the connector frame such that the multiple protruding members extend substantially perpendicular to the connector frame and are located on opposing side walls of the connectors frame.

13 Claims, 6 Drawing Sheets

CONNECTOR GUIDE ASSEMBLY WITH A PROTRUDING MEMBER

BACKGROUND

Electrical connectors may be used for joining together electrical circuits. The connectors may use electrical pin-outs to reference the contacts of the electrical connector with the corresponding function.

BRIEF DESCRIPTION OF THE DRAWINGS

In the accompanying drawings, like numerals refer to like components or blocks. The following detailed description references the drawings, wherein.

DETAILED DESCRIPTION

Electrical connectors may be joined to corresponding electrical contacts. In this situation, the electrical connectors are aligned with one another to ensure the pin-out from one connected are appropriate mated to the pin-outs in another connector. If these electrical connectors are improperly aligned, the pin-outs may become damaged. Several approaches have been implemented to prevent connector damage. One approach blindly aligns the connectors to mate the connectors together which may still cause connector damage. Another approach uses a guide pin to mate the connectors together; however if the connectors move parallel to one another, the guide pins may also cause damage to the connectors. Yet a further approach may include a mechanical support to prevent the electrical connectors from mating prior to alignment. The mechanical support may use alignment features that may be molded into the connector housing or on separate and guide pins and receptacles. These alignment features may work by roughly aligning the connectors close enough to mate that the "fine" alignment features of the connector housings can engage or act as both the rough and fine alignment features so that the connectors can reliably mate. However, the mechanical support may conflict with the connector features which may result in a non-reliable interconnect and/or damage to the connector.

To address these issues, examples disclose a mechanism to prevent connector damage and provide a reliable interconnection between connectors. The present disclosures provides a connector guide assembly comprising a connector frame and multiple protruding members connected to the connector frame. The multiple protruding members extend perpendicularly to the connector frame and are located on opposing side walls. The protruding members help align and the guide the connector prior to fully mating with another connector.

In another example, the protruding members may be aligned prior to mating the connector. In this example, the structure of each protruding member reaches above the connector. Thus, the protruding members are aligned with other assemblies prior to mating the connector. Aligning the protruding members prior to proceeding with connector mating, prevents conflicts with the connector mating features.

The following detailed description refers to the accompanied figures. Wherever possible, the same reference numbers are used in the figures and the following description to refer to the same or similar parts. It is to be expressly understood, however, that the figures are for the purpose of illustration and description only. While several examples are described throughout, modification, adaptions, and other implementations are possible. Accordingly, the following detailed description is not meant to limit the disclosed examples, rather it is meant to provide proper scope of the disclosed examples and may be defined by the appended claims.

Figure 1B:
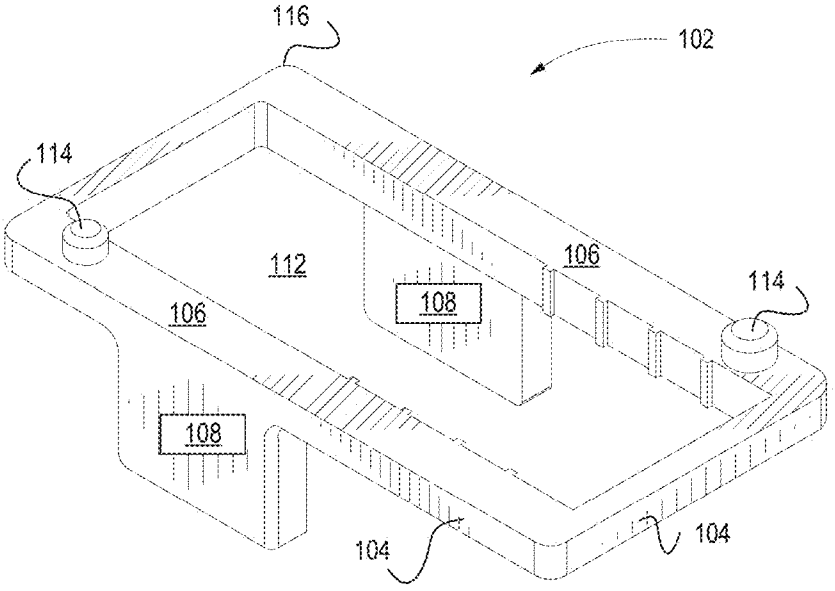
FIGS. 1A-1B illustrate various perspectives of an example connector guide assembly including multiple protruding members in accordance with the present disclosure.
Figure 1A:
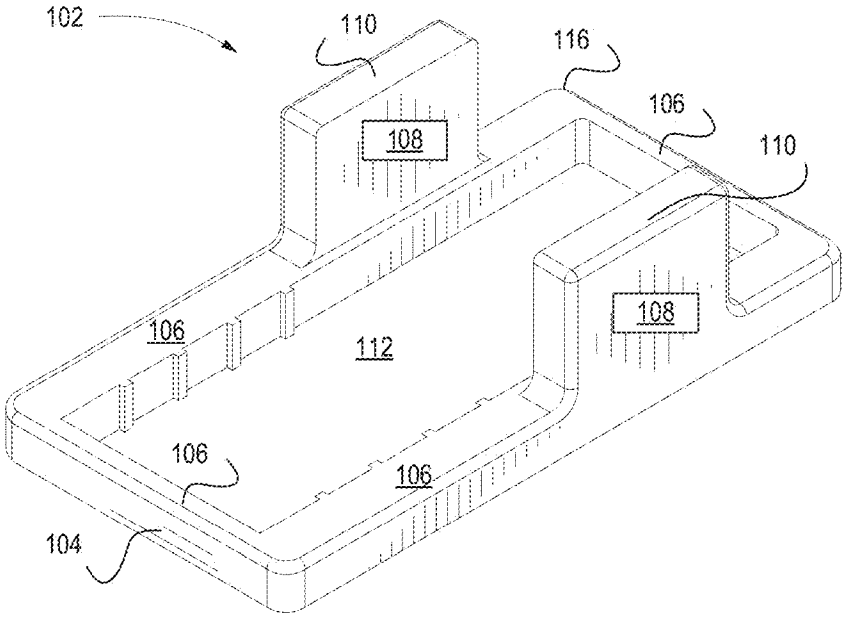

FIGS. 1A-1B illustrate various perspectives of an example connector guide assembly 102. Connector guide assembly 102 includes connector frame 116 which includes multiple side walls 104 arranged to produce aperture 112. Additionally, connector guide assembly 102 includes multiple surfaces 106 and multiple protruding members 110 coupled to multiple side walls 104. For clarification purposes, the term multiple side walls, multiple surfaces, and multiple protruding members may be used interchangeably herein with terms surfaces, side walls, and protruding members.

FIG. 1A illustrates a top perspective of connector guide assembly 102 including connector frame 116. Connector frame 116 comprises side walls 104 positioned that creates aperture 112. Each of side walls 104 includes surface 106 which is coupled to protruding members 108. Protruding members 108 may be located on opposing side walls and coupled substantially perpendicular to connector frame 116. Each protruding member 108 includes surface 110 which may be aligned for mating to a different connector assembly. Connector guide assembly 102 may be placed within a computing device to mate together a connector coupled to connector guide assembly 102 with another connector. In a specific example, connector guide assembly 102 may be used in a server. These implementations may be discussed in detail in later figures.

Side walls 104 are continuous blocks of material that may be used as a boundary of connector frame 116. As such, these side walls 104 may be arranged in a shape to create aperture 112. The shape of aperture 112 corresponds to the connector which is coupled to connector guide assembly 102. Each of side walls 104 includes surface 106. Surface 106 may be considered the uppermost layer of side walls 104. In one implementation, surfaces 106 may be comprised a flat surface which may run perpendicular to protruding members 108. In this implementation, the connector frame 106 is substantially flat while protruding members 108 are coupled to the connector frame that is raised perpendicularly from connector frame 116. Side walls 104 and surfaces 106 may be composed of various materials including but not limited to: metal, ceramic, plastic, polyurethane, or combination thereof. Although FIGS. 1A-1B illustrate connector guide assembly 102 as comprising four side walls 104, this was done for illustration purposes. For example, connector guide assembly 102 may include at least two side walls or more than four side walls, etc.

Aperture 112 is a space created from the positions or arrangements of side walls 112. Aperture 112 may receive a connector (not illustrated) prior to mating with another connector. In this implementation, the connector may be pressed or affixed into connector assembly guide 102 such that the connector is coupled to connector assembly guide 102. Protruding members 108 may rise higher or above the received connector so that corresponding protruding member is aligned to protruding members 108 prior to making contact with the connector. The alignment of protruding member to corresponding protruding member to mate together connectors may be discussed in detail in later figures. Aperture 112 may be shaped based on arrangement of side walls 106 to receive the connector. As such, aperture 112 may be shaped based on the shape of the connector. The shape allows the connector to be positioned on a circuit board to provide electrical connections between the circuit board and the connector.

Protruding members 108 may include structure features as part of connector guide assembly 102 that extend substantially perpendicular to connector frame 116. Protruding members 108 are coupled to at least two opposing side walls on connector frame 116. Although the two opposing side walls are illustrated as left to right, the protruding members 108 may be coupled to the front and back side walls. In one implementation each protruding member 108 rises above the connector placed in aperture 112. In this implementation, surfaces 110 on each protruding member 108 may be used to properly align and mate connectors together. Surfaces 110 are the most top portion of each protruding member 108 that aligns with a corresponding protruding member on a different connector assembly guide. In one implementation, surfaces 110 may be comprised a flat surface which runs parallel to surface 106. In another implementation, surfaces may be comprised of a physical feature used to fit or align to a corresponding protruding member on a different connector assembly guide. For example, surfaces 110 may include a beveled, raised, keyed, or other type of physical feature used to align to the corresponding protruding member. As such, protruding members 108 may be shaped according to the corresponding protruding member. Additionally, although FIGS. 1A-1B illustrate protruding members 108 as directly opposing one another, protruding members 108 may indirectly oppose one another with minimal overlap.

FIG. 1B illustrates an underside perspective of connector guide assembly 102. Connector guide assembly 102 includes side walls 104 and surfaces 106. Additionally, connector guide assembly 102 may include retention members 114. Retention members 114 may be used as infrastructure components to the connector guide assembly 102 and placed on the underside of connector frame 116. The underside portion of connector guide assembly 102 may be used to couple assembly 102 and the connector (not illustrated) to a circuit board. In this implementation, retention members 114 are located on the side (e.g., underside) of connector frame 116 that opposes the side (top side) of protruding members 108. In one implementation, retention members 114 may be composed of the same material as connector frame 116 and protruding members 108. The shape of retention members 114 may be pegs, squared, round, etc.

Figure 2B:
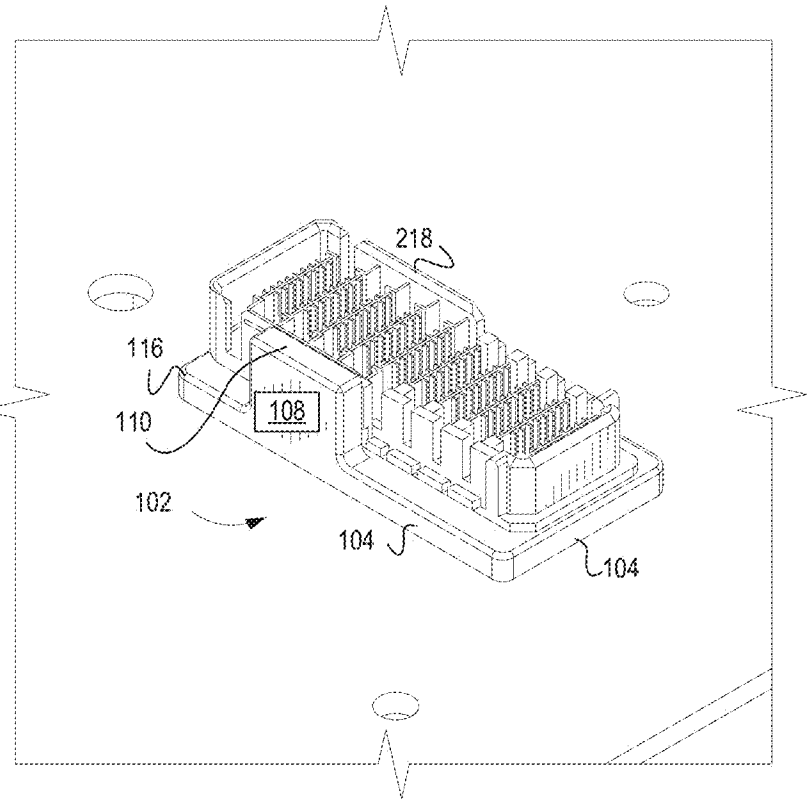
FIGS. 2A-2B illustrate a top perspective of an example connector guide assembly including multiple protruding members and a connector in accordance with the present disclosure.
Figure 2A:
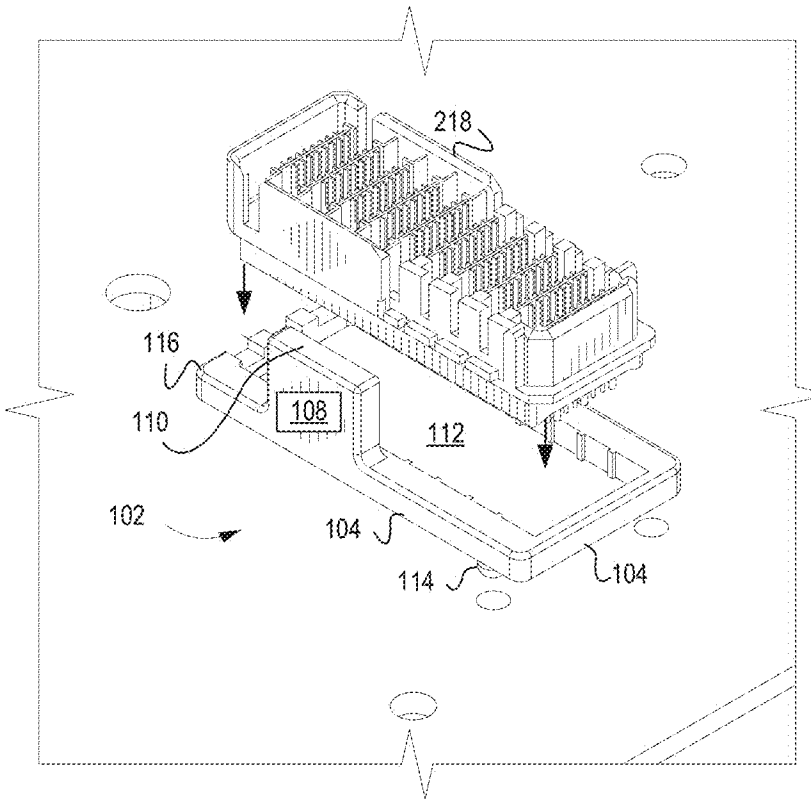

FIGS. 2A-2B illustrate a top perspective of connector guide assembly 102 prior to placement of connector 218 and after placement of connector 218. Connector 218 is an electro-mechanical device which may be used to join different circuits together. Implementations of connector 218 include, by way of example, plug and socket connector, male plug, female plug, serial port connector, blade connector, modular connector, universal serial bus (USB), or other type of electro-mechanical device. In another implementation, connector 218 may include a rim to aid in placement of connector 218 in aperture 112.

Specifically, FIG. 2A illustrates connector guide assembly 102 prior to placement of connector 218. Connector 218 may be placed within aperture 112 of connector assembly guide 102. The connector 218 may be pressed, soldered, and/or affixed such that electrical connections are between the circuit board and connector 218. Protruding members 108 are located on either side of connector frame 116 and may extend substantially perpendicular to connector frame 116. Extending substantially perpendicular indicates each protruding member 108 is located perpendicular to connector frame 116 to some extent. Additionally, the location of protruding members 108 on either side of connector frame 116 may also be interpreted as each protruding member 108 on opposing sides of connector frame 116. This enables connector 218 to include protruding member 108 on either side as seen in FIG. 2B.

FIG. 2B illustrates the placement of connector 218 into aperture 112 of connector guide assembly 102. In this implementation, connector 218 is retained by connector guide assembly 102. For example, connector guide assembly 102 may include mechanical portions in which to couple connector 218 to connector frame 116 and protruding members 108. Protruding members are used to properly align connector 218 to another connector for mating. In this implementation, protruding members 108 serve as a blind-mate feature to prevent connector and pinout damage.

FIGS. 3A-3D illustrate an orthogonal alignment between first and second protruding members 108 and 308. First protruding member 108 is coupled to first connector guide assembly 102 while second protruding member 308 is coupled to second connector guide assembly 302. The orthogonal alignment between protruding members 108 and 308 enable first connector 218 and second connector 318 to mate while preventing connector damage. In these figures, first connector guide assembly 102 including first protruding member 108, first connector frame 116, and first connector 218 may remain stationary while second connector guide assembly 302 including second protruding member 308, second connector frame 316, and second connector 318 may be positioned and moved.

Figure 3B:
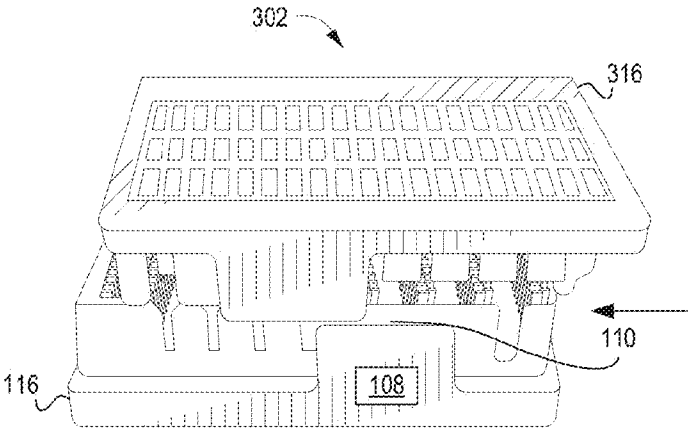
FIGS. 3A-3D illustrate an example alignment between a first protruding member coupled to a first connector guide assembly and a second protruding member coupled to a second connector guide assembly to mate together a first and second connector in accordance with the present disclosure.
Figure 3D:
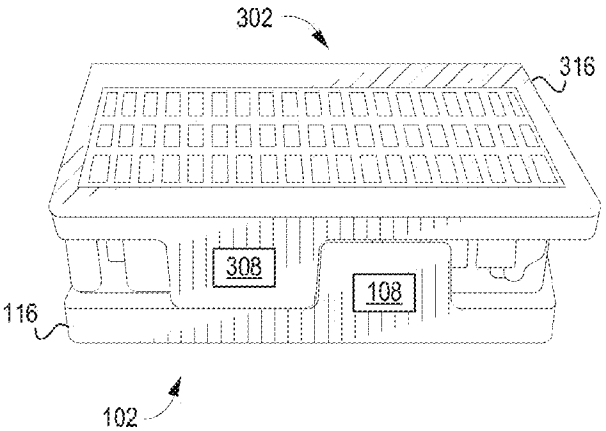
Figure 3A:
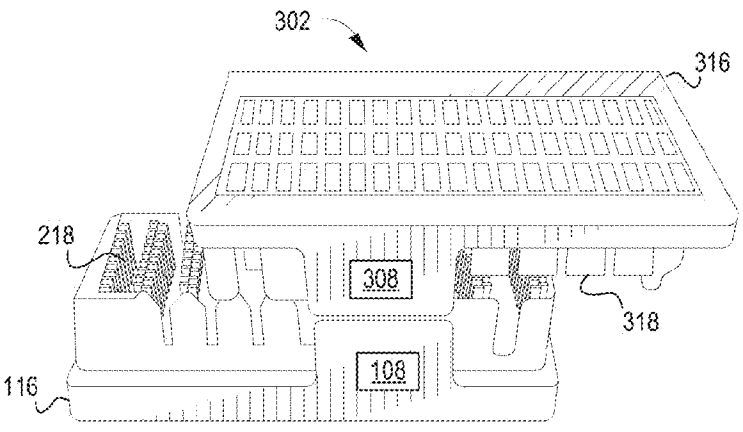

FIG. 3A may be referred to as nominal installation position. In this position, protruding members 308 and 108 are initially aligned. For example, the surface 110 corresponding to first protruding member 108 is brought into substantial contact with the surface corresponding to second protruding member 308. Protruding members 108 and 308 rise above respective connectors 218 and 318, accordingly. This means surfaces to protruding members 108 and 308 are brought into substantial contact with one another prior to making contact between connectors 218 and 318. Bringing protruding members 108 and 308 into substantial contact with one another prior to connectors 218 and 318 prevents conflict between these connectors 218 and 318. In this position, connectors 218 and 318 are not in contact with one another allowing a space between connectors 218 and 318.

FIG. 3B illustrates how the surface of the second protruding member 308 may move along the surface 110 of first protruding member 108. Upon making substantial contact between the surfaces between protruding members 108 and 308, second protruding member 308 is moved in parallel direction to first protruding member 108. Second protruding member may be moved to clear the surface 110 of first protruding member 108. In this position, there may still be space between connectors 218 and 318. This space indicates there is no contact between connectors 218 and 318. Although FIG. 3B illustrates second protruding member 308 moving from right to left across first protruding member 108, this was done for illustration purposes and not for limiting implementations. For example, second protruding member 308 may move from left to right across first protruding member 108.

Figure 3C:
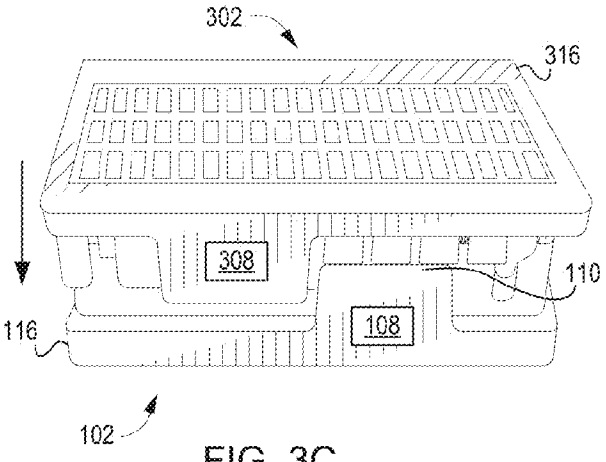

FIG. 3C illustrates how second protruding member 308 is moved substantially perpendicular to first protruding member 108. Upon clearing the surfaces between protruding members 108 and 308, second connector guide assembly 302 is moved downward. In this position, connectors 218 and 318 are brought closer together, to initialize contact. Based on moving second protruding member 308 further down first protruding member 108, connectors 218 and 318 may fully mate as in FIG. 3D.

FIG. 3D illustrates how connectors 218 and 318 are fully mated together. In this position, the protruding members 108 and 308 are in contact with respective side surfaces to fully mate connectors 318 and 218. Additionally, second protruding member is moved further in a vertical or downward connection to fully mate to second connector 318 to first connector 218.

Figure 4B:
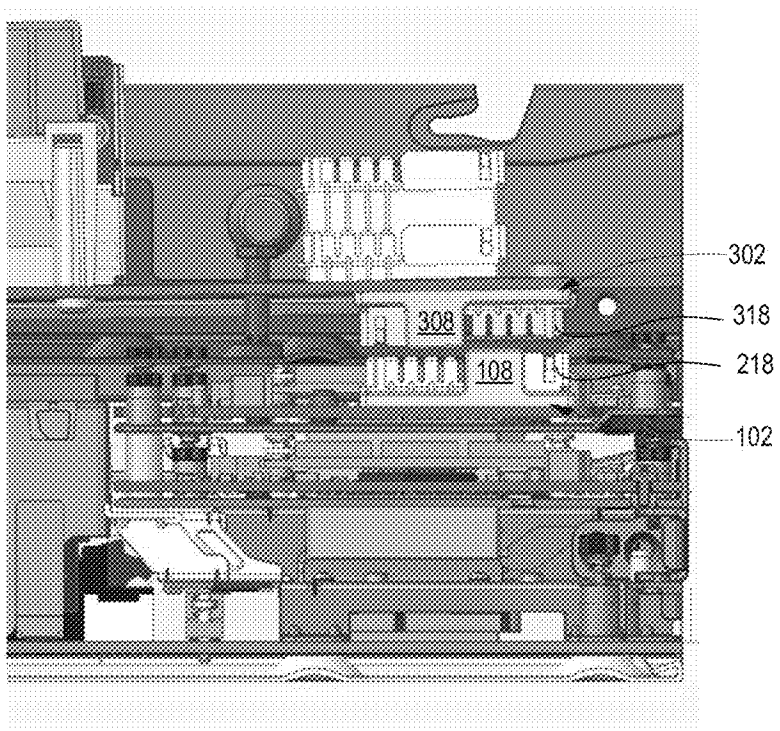
FIGS. 4A-4B illustrates an example system including first and second connector guide assemblies and protruding members for fully mating a first and second connector in accordance with the present disclosure.
Figure 4A:
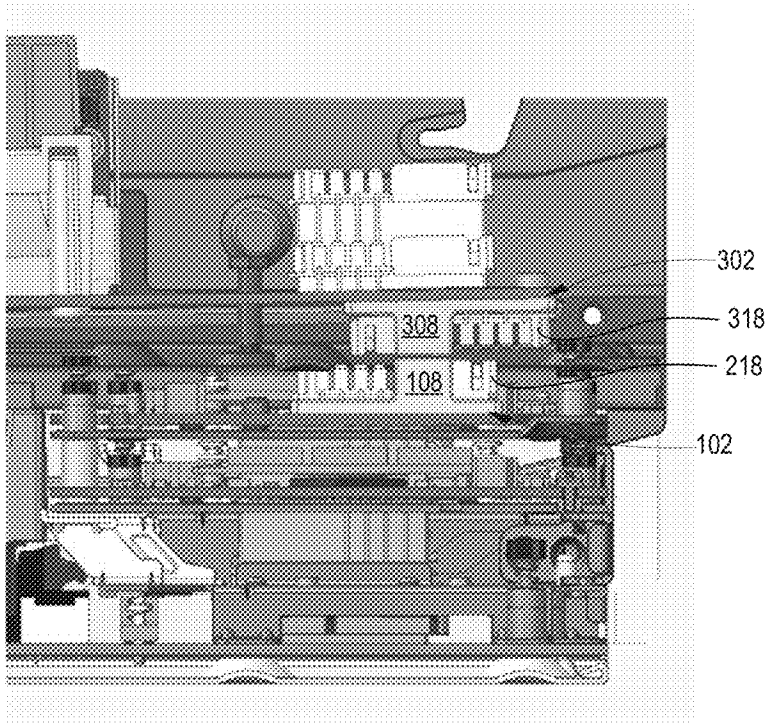

FIGS. 4A-4B illustrate an example system implementing connector guide assemblies 102 and 302 to mate connectors 218 and 318. As such, protruding members 108 and 308 may orthogonally align together prior to fully mating connectors 218 and 318 to join together multiple servers.

FIG. 4A illustrates an alignment of the surfaces between protruding members 108 and 308. The protruding members 108 and 308 server as a blind guide to ensure both servers are aligned prior to mating connectors 218 and 318. In this figure, protruding members 108 and 308 are brought into substantial contact with one another. Alternatively, the servers may be brought into contact with one another through aligning protruding members 108 and 308. Based on aligning the protruding members 108 and 308, second protruding member 308 may be moved across first protruding member 108 as in FIG. 3B.

FIG. 4B illustrates how the top server may be moved across the bottom server by aligning and moving the second protruding member 308 surface across the first protruding member 308. Upon aligning these members 108 and 308, the top server may mated to the bottom server by fully mating first and second connectors 218 and 318. In this implementation, the top server may move in a vertical manner relative to the bottom server thus enabling connectors 218 and 318 to fully mate.

Figure 5:
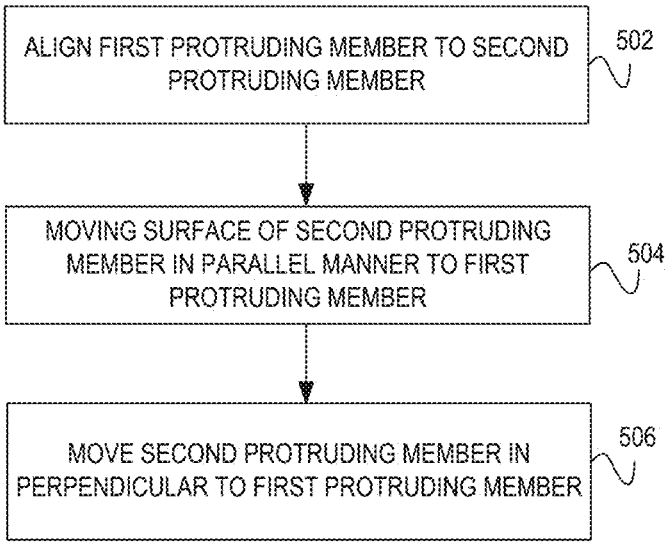
FIGS. 5-6 illustrate example flow diagrams for mating together a first connector coupled to a first connector guide assembly and a second connector coupled to a second connector guide assembly in accordance with the present disclosure.
Figure 6:
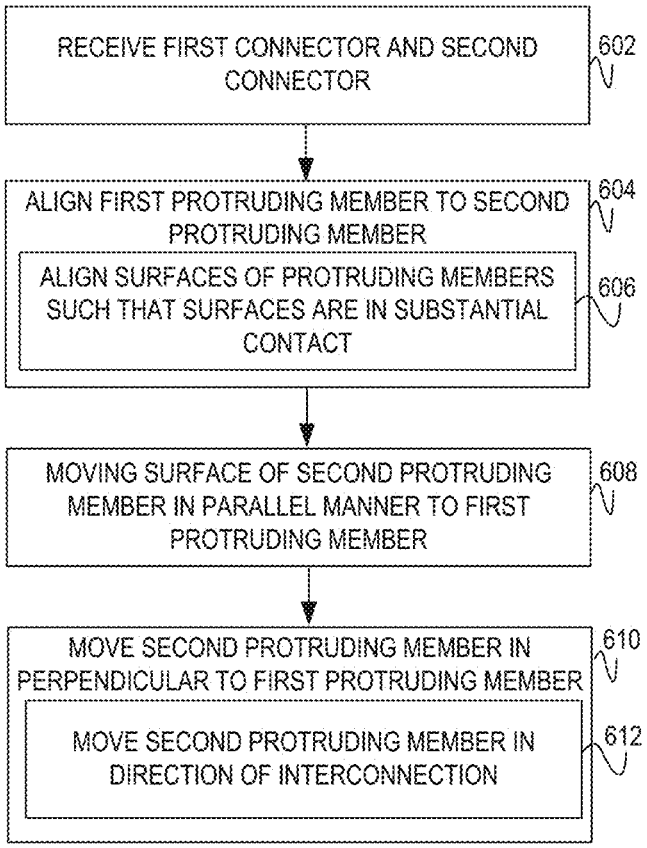

Referring now to FIGS. 5 and 6, flow diagrams are illustrated in accordance with various examples of the present disclosure. The flow diagrams represent processes that may be utilized in conjunction with various systems and devices as discussed with reference to the preceding figures. While illustrated in a particular order, the flow diagrams are not intended to be so limited. Rather, it is expressly contemplated that various processes may occur in different orders and/or simultaneously with other processes than those illustrated.

FIG. 5 is a flow diagram illustrating an example method of aligning protruding members together to mate electrical connectors. A first protruding member is located on a first connector assembly guide while a second protruding member is located on a second connector assembly guide. Each protruding member is positioned perpendicularly to a frame of each respective connector assembly guide. A surface on the second protruding member is brought into contact with a surface on the first protruding member. The second protruding member surface is moved in parallel manner to the first protruding member. The second protruding member may proceed to move in perpendicular manner to the first protruding member. Moving the second protruding member in the perpendicular manner mates the first connector within the first connector assembly guide to the second connector within the second connector assembly guide. Using the protruding members to guide and mate the connectors without causing a conflict with the contacts in the connectors and preventing damage. The method as illustrated in FIG. 5 may be performed by a guiding assembly and the corresponding components as in FIGS. 1A-1B and FIGS. 2A-2B. In discussing FIG. 5, operations 502-506 may be performed by components as illustrated in the previous figures. As such, references may be made to such components for purposes of clarification and not to limit such implementations. For example, first connector guide assembly 102 may operate in conjunction with second connector guide assembly 302 to mate together a first connector and a second connector.

At operation 502, the first protruding member located on the first connector guide assembly is aligned to the second protruding member located on the second connector guide assembly. In one implementation, the surface of the first protruding member is brought in substantial contact with the second protruding member. In this implementation, each protruding member includes a physical feature that corresponds to the other member such that the physical features align both members together. As such, the physical feature may include a flat surface, a beveled surface, keyed surface, or other type of physical feature that aligns both protruding members together. Upon aligning the protruding members together on the different connector assembly guides, the surface of the second protruding member may slide or move across the surface of the first protruding member.

At operation 504 based on the alignment of first protruding member to the second protruding member, the surface of the second protruding member may move across in a parallel manner to the surface of the first protruding member. The second protruding member may move across the first protruding member until the surface of the second protruding member clears the surface of the first protruding member. Clearing the surface allows the respective connectors to mate without conflict. In another implementation, the second protruding member moves in a perpendicular direction to the interconnection of the connectors.

At operation 506 based on the second protruding member moving across the first protruding member, the second protruding member proceeds to move in perpendicular manner to the first protruding member. The movement of the second protruding member in the perpendicular direction mates the first and second connectors. In an implementation the movement of the second protruding member is positioned in the direction of the interconnection of the connectors. In a further implementation, the second protruding member moves in a downward direction to mate the connectors.

FIG. 6 is flow diagram illustrating an example method of moving a first and second connector guide assembly in various directions. The connector guide assemblies are positioned in different directions for mating together a first connector and a second connector which are each coupled to the respective guide assembly. The method as illustrated in FIG. 6 may be performed by multiple connector guide assemblies and corresponding components, such as protruding members as illustrated in FIGS. 1A-1B and FIGS. 2A-2B. In discussing FIG. 5, operations 502-506 may be performed by components as illustrated in the previous figures. As such, references may be made to such components for purposes of clarification and not to limit such implementations. For example, first connector guide assembly 102 may operate in conjunction with second connector guide assembly 302 to mate together a first connector and a second connector.

At operation 602, each connector guide assembly receives a connector prior to alignment of the protruding members. In this implementation, each connector guide assembly includes multiple side walls that are arranged to create an aperture. The aperture creates an opening or hole within each connector guide assembly. Each aperture is configured to receive a connector for mating together. In this implementation, the first connector is coupled to the first connector guide assembly and the second connector is coupled to the second connector guide assembly.

At operation 604, the first protruding member located on the first connector guide assembly is aligned to the second protruding member located on the second connector guide assembly. In one implementation, the first protruding member includes a surface which makes substantial contact with the surface of the second protruding member. Operation 604 may be similar in functionality to operation 502 as in FIG. 5.

At operation 606 the surfaces of the first protruding members and the second protruding member may reach substantial contact with one another. The connector assembly guides may be lifted or raised so that each surface of the protruding members make substantial contact. Substantial contact may indicate that the area on each surface is in direct contact with each other. This allows each of the respective connector guide assemblies to blindly mate together. In this manner, the surfaces provide a guiding mechanism in which to move protruding members.

At operation 608, the surface of the second protruding member is moved parallel to the surface of the first protruding member. In one implementation, the surfaces of both protruding members are in substantial contact with one another. Upon making the substantial contact, the second protruding member is moved along the surface of the first protruding member. Operation 608 may be similar in functionality to operation 504 as in FIG. 5.

At operation 610 based on moving the second protruding member along the surface of the first protruding member, the second protruding member proceeds to move in a perpendicular manner to the first protruding member. The surfaces of both protruding members may be cleared one another, thus allow the second protruding member to move in the perpendicular manner. In this implementation, the second protruding member may be positioned in a downward manner to the first protruding member. This allows the second connector coupled to the second protruding member to mate to the first connector coupled to the first protruding member. Operation 610 may be similar in functionality to operation 506 as in FIG. 5.

At operation 612, a side surface to the second protruding member is kept in contact with a side surface of the first protruding member. Aligning both side surfaces of the protruding members together, the second protruding member may be moved in a downward direction to first protruding member. In this example, the first protruding member may remain stationary while the second protruding member is moved to mate the connectors together.

Although certain embodiments have been illustrated and described herein, it will be greatly appreciated by those of ordinary skill in the art that a wide variety of alternate and/or equivalent embodiments or implementations calculated to achieve the same purposes may be substituted for the embodiments shown and described without departing from the scope of this disclosure. Those with skill in the art will readily appreciate that embodiments may be implemented in a variety of ways. This application is intended to cover adaptions or variations of the embodiments discussed herein. Therefore, it is manifestly intended that embodiments be limited only by the claims and equivalents thereof.

I claim:

1. A connector guide assembly comprising:

a connector frame including multiple side walls; and multiple protruding members coupled to the multiple side walls of the connector frame such that the multiple protruding members extend substantially perpendicular to the connector frame and are located on opposing side walls of the connector frame;

wherein the multiple protruding members of the connector frame mate with different protruding members of a different connector guide assembly in response to the different protruding members moving:

parallel along a surface of the multiple protruding members of the connector guide assembly; and a side surface of the different protruding members perpendicularly in a downward direction relative to the multiple protruding members of the connector guide assembly.

2. The connector guide assembly of claim 1 comprising:

multiple retention members coupled to the connector frame such that the multiple retention members are located on a side of the connector frame opposing the multiple protruding members.

3. The connector guide assembly of claim 1 wherein the multiple side walls are arranged to produce an aperture in the connector frame, wherein the aperture receives a connector.

4. The connector guide assembly of claim 1 wherein each of the multiple side walls comprises:

a surface to support the multiple protruding members.

5. The connector guide assembly of claim 1 wherein each of the multiple protruding members comprises:

a surface positioned parallel to at least one of the multiple side walls of the connector frame.

6. The connector guide assembly of claim 1 wherein each of the multiple protruding members includes a surface to align with and couple to the different connector guide assembly.

7. A system comprising:

a first connector guide assembly comprising:

a first connector frame; and a first protruding member coupled to the first connector frame that extends the first protruding member substantially perpendicular to the first connector frame;

a second connector guide assembly comprising:

a second connector frame;

a second protruding member coupled to the second connector frame such that the second protruding member extends substantially perpendicular to the second connector frame and is configured to align with the first protruding member such that the alignment places the first connector frame substantially parallel to the second connector frame; and the second protruding member is to:

move parallel along a surface of the first protruding member; and move perpendicularly in a downward direction relative to the first protruding member such that the movements mate a first connector coupled to the first connector frame to a second connector coupled to the second connector frame.

8. The system of claim 7 wherein the first connector frame is coupled to a first connector and the second connector frame is coupled to a second connector.

9. The system of claim 8 wherein the second protruding member is positioned to align with the first protruding member such that the first connector mates to the second connector.

10. The system of claim 7 wherein the first protruding member and the second protruding member each comprise a surface positioned to align the protruding members together.

11. A method to mate a first connector and a second connector, the method comprising:

aligning a first protruding member located on a first connector guide assembly to a second protruding member located on a second connector guide assembly;

moving a surface of the second protruding member substantially parallel to a surface of the first protruding member; and moving the second protruding member substantially perpendicular to the first protruding member by moving a side surface of the second protruding member in a downward direction relative to a side surface of the first protruding member such that a first connector coupled to the first connector guide assembly mates to a second connector coupled to the second connector guide assembly.

12. The method of claim 11 comprising:

receiving a first connector by the first connector guide assembly and a second connector by the second connector guide assembly.

13. The method of claim 11 wherein aligning the first protruding member located on the first connector guide assembly to the second protruding member located on the second connector guide assembly comprises:

aligning the surface of the first protruding member to the surface of the second protruding member such that the surfaces of the protruding members are in substantial contact with one another.

* * * * *